US006105165A

United States Patent [19]

Johnson et al.

[11] Patent Number: 6,105,165

[45] Date of Patent: Aug. 22, 2000

[54] POP-OUT BABY/ADULT BIB

[76] Inventors: Noriko T. Johnson; Justin J. Johnson, both of 905 W. Juniper Ave, Santa Ana, Calif. 92707

[21] Appl. No.: 08/968,590

[22] Filed: Nov. 13, 1997

[51] Int. Cl.[7] ..... A41B 13/10; A41D 27/20

[52] U.S. Cl. ..... 2/49.2; 2/46; 2/48; 2/247

[58] Field of Search ..... 2/46, 47, 48, 49.1, 2/49.2, 49.3, 49.4, 49.5, 50, 51, 52, 174, 247, 248, 249, 250, 251, 252, 255, 256, 257, 258, 259, 260, 260.1, 261, 262, 263, 264, 271; D2/860, 861, 862, 863, 864

[56] References Cited

U.S. PATENT DOCUMENTS

| | | | |
|---|---|---|---|
| 677,010 | 6/1901 | Ziller | 2/49.2 |
| 3,407,407 | 10/1968 | Hollander et al. | 2/49.2 |
| 5,671,479 | 9/1997 | Dedrick | 2/48 |

*Primary Examiner*—Jeanette Chapman

[57] ABSTRACT

The collapsible, pop-out bib of the present invention includes a lower bowl section to catch food or beverage spills. Said lower bowl section comprises a guide sewn into it's upper edge, this guide is created by either a simple fold in the web material's fabric, or by attaching a fabric tape or bias tape to the upper edge of the lower bowl section and continues around the entire perimeter of the lower bowl section's upper edge. The bib of claim also comprises an enlongated flexible spring material that is inserted into said upper edge guide to continue around the entire perimeter of the lower bowl section's upper edge. Said spring material comprises a male/female connector on opposing ends that enable the ends to be fastened together to form a large single-looped configuration, thereby creating tension on the periphery of the upper edge of said bowl, which holds the bowl out and open to catch spills. Said bib is reversibly collapsible by twisting the spring material out of it's plane to form ann odd numbered multi-looped configuration, resulting in a relatively small and convenient storage size.

4 Claims, 5 Drawing Sheets

POP-OUT BABY/ADULT BIB

CROSS REFERENCE TO RELATED APPLICATIONS

| CROSS REFERENCE TO RELATED APPLICATIONS | | | |
|---|---|---|---|
| 277,178 | 5/1883 | Webb | 2/51 |
| 615,293 | 12/1898 | Maier | |
| 677,010 | 6/1901 | Ziller | 2/49.2 |
| 1,108,557 | 8/1914 | Dudley | |
| 2,091,083 | 8/1937 | Polikoff | 2/49.1 |
| 2,532,932 | 12/1950 | Nieswander | |
| 2,643,384 | 6/1953 | Thompson | |
| 2,648,845 | 8/1953 | Berman | 2/48 |
| 2,672,614 | 3/1954 | Zimmerman et al. | 2/49.3 |
| 2,697,222 | 12/1954 | Reid | |
| 2,738,511 | 3/1956 | Brady | |
| 3,210,733 | 10/1965 | Lewis | 2/48 |
| 3,407,407 | 10/1968 | Hollander et al | |
| 4,114,199 | 9/1978 | Malan | |
| 4,215,432 | 8/1980 | Smith | 2/48 |
| 4,660,224 | 4/1987 | Ashcraft | 2/48 |
| 4,815,784 | 3/1989 | Zheng | |
| 4,946,094 | 8/1990 | Stang | |
| 5,056,159 | 10/1991 | Zemke, Jr. | |
| 5,062,558 | 11/1991 | Stang | |
| 5,075,897 | 12/1991 | Daniels | 2/49.4 |
| 5,671,479 | 9/1997 | Dedrick | |
| FOREIGN PATENT DOCUMENTS | | | |
| 30834 | 1/1932 | Australia | 2/52 |
| 908598 | 10/1962 | United Kingdom | 2/52 |

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates to a bib that an infant, elderly, or invalid may wear to cover clothing, and specifically relates to a collapsible bowl of flexible material with a spring support that can be reversibly folded simply by twisting it.

BACKGROUND OF THE INVENTION

Bibs have long been used by people to protect infants and invalids from spilled foods and liquids. Bibs have been modified to make them more efficient at catching spills such as by including pockets, attaching the bib to a table, or tray of an infant's chair, or attaching a tray to the bib.

Prior art bibs have also been modified to include for example, a bib disclosed in U.S. Pat. No. 615,293 in which the lower edge forms a pocket when drawcords on the sides are fastened properly. U.S. Pat. No. 2,532,932 discloses a bib in which the lower edge attaches to the infant's chair to form a pocket and tray cover. U.S. Pat. No. 2,738,511 similarly claims a bib which covers a tray on an infant's chair and a means to attach a bowl to the tray cover. U.S. Pat. No. 2,697,222 discloses a bib in which the sides and lower edges are gathered to form a seamless pocket. U.S. Pat. No. 2,643,384 discloses a bib in which the lower edge is turned upward to form a pocket which is attached by suction cups to a surface on an infant's chair. U.S. Pat. No. 3,407,407 discloses a bib with an attached pocket that is held open by a frame.

Because such bibs would generally be used temporarily while traveling, or while sitting in a car or similar confined space, it is important that the bib be easily stored when not in use. Thus there is a need for a collapsible pocket bib.

Flexible spring materials can be formed into loops that are circular. Such circular loops can be twisted out of the plain of the single loop to collapse and fold the loop into a series of odd-numbered connected smaller loops. Folding produces a smaller multi-looped configuration relative to the plane or the extended loop (as illistrated in FIG. 13 of U.S. Pat. No. 4,815,784). The loop can be restored to its open single-loop configuration simply by twisting it in the opposite direction.

Recently, flexible circular loops covered with fabric have been used to make a cloth hat sold in the orient, and an automobile sunshield. The latter, disclosed in U.S. Pat. No. 4,815,784 comprises a pair of flexible circular loops, each covered with fabric, joined together with a fabric hinge to produce a broad elliptical shaped shield when opened.

All of the proir art modified bibs that include integral pockets formed from the lower portion of the bib have stiff supports to maintain the shape of the pocket or tray. None of the prior art bibs are reversibly collapsible into a smaller configuration of connected loops. Furthermore, although some prior art bibs include stiff supports such as plastic frames steel wire, whalebone, cane, woven horse-hair, buckram cord, India rubber or the like, none uses a spring element to create a flexible circular loop that supports the upper-edge of the bibs pocket. Finally, none of the prior art bibs disclose a reversibly collapsible configuration that enable them to be folded into a smaller multi-looped configuration for ease of storage.

SUMMARY OF THE INVENTION

The collapsible bib of the present invention can be conveniently folded into a smaller size merely by twisting the spring material, (which runs through a guide, created by a tuck in the web material all the way around and sewn into the upper edge of said bowl), into a smaller multi-looped configuration.

In the present invention, a collapsible bib includes a spring material in the periphery of a bowl made of flexible material. The entire bib is collapsible by laying the top bib and neck enclosure portion of the bib down into said lower bowl section of the bib and twisting said flexible spring material out of its plane to form an odd number of smaller connected loops. In this relatively small configuration the bib is easily stored. When needed simply twist the bib in the opposite direction of that used to collapse the loop, and the bib will automatically pop out into an open singe-looped, ready for use position.

According to the present invention, there is provided a foldable bowl including a flexible web sufficient in size to protect the lap of a wearer. Said foldable bowl also includes an enlongated sping material in the form of a loop attached to the periphery of the flexible web material running through a guide sewn into the upper edge of the bib's bowl section, thereby creating an outward tention on the upper edge of said bowl section, also adapted to fold into a smaller multi-looped configuration upon twisting the spring material out of the plane of a single loop.

In one preferred embodiment, said spring applies outward tension around the entire periphery of the upper edge of said bowl's webbing material, thereby creating a bowl located at the lower section of the bib. The bib is attached around the neck of a wearer by ties. In preferred embodiments, said flexible spring material is inserted into, and runs through a guide sewn horizontally around the top edge of said lower bowl section, continuing around the entire perimeter of said upper-edge of said bowl section. Said guide is created by a simple fold sewn into the web material.

It should be understood that both the foregoing general description and the following detailed description are exemplary only and are not restrictive of the invention as claimed. The accompanying drawings, which are incorporated in and constitute a part of the specification, illustrate various embodiments of the invention and, together with the description, serve to explain the principles of the present invention.

DETAILED DESCRIPTION OF THE INVENTION

Figure 3:
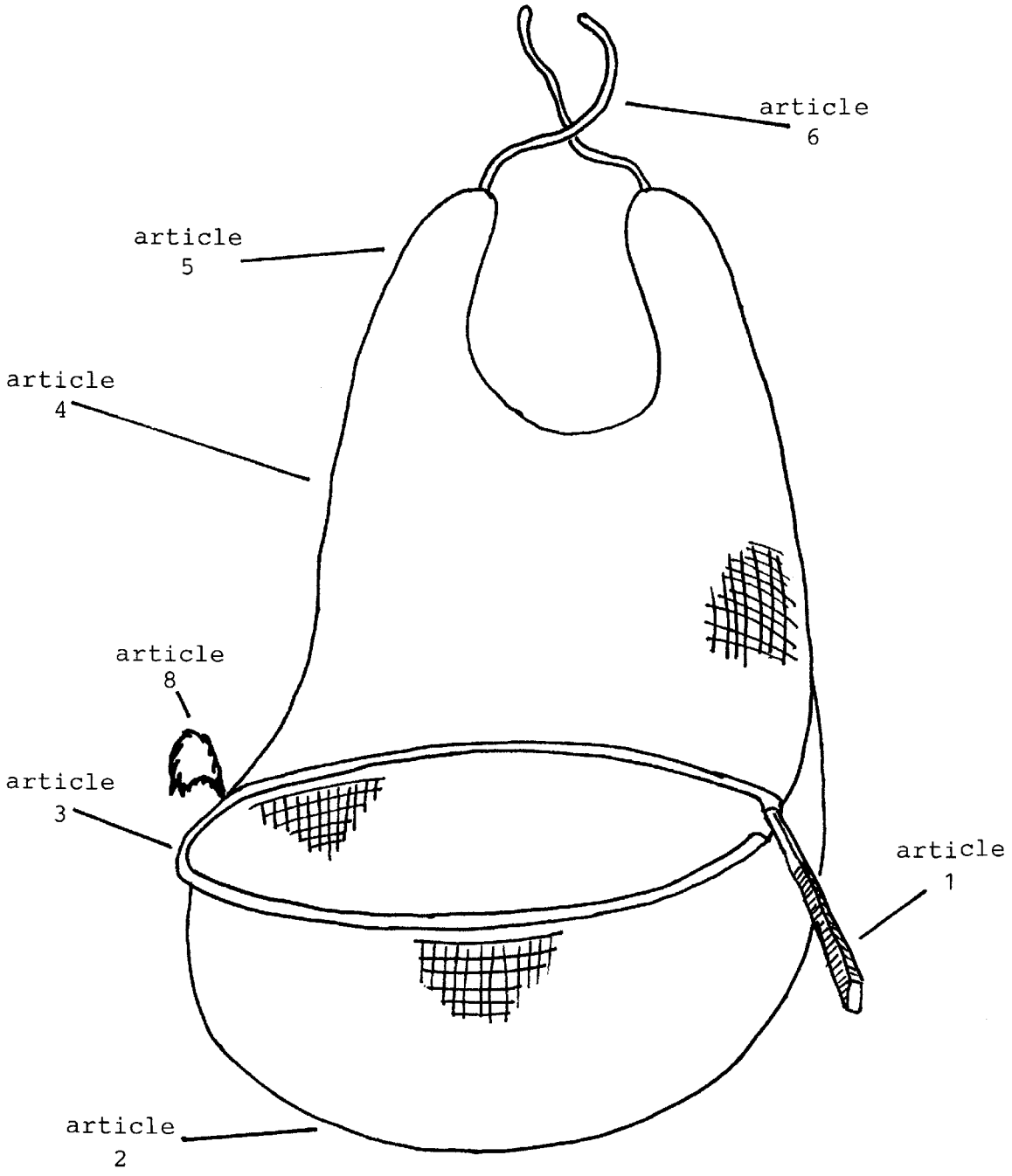
FIG. 3 is a plan view of an embodiment of the collapsible bib's spring material (FIG. 3 article 1), which is inserted into a guide (FIG. 3 article 3), that continues to encircle the entire periphery of the upper edge of said lower bowl section (FIG. 3 article 2). The spring material comprises a male/female connector on opposing ends, to be fastened together to form a single-loop configuration once inserted into said fabric guide.

Referring to the figures, the reversibly collapsible bib of the present invention includes a spring loop (FIG. 3 article 1), as a peripheral support for a bowl (FIG. 3 article 2).

Figure 1:
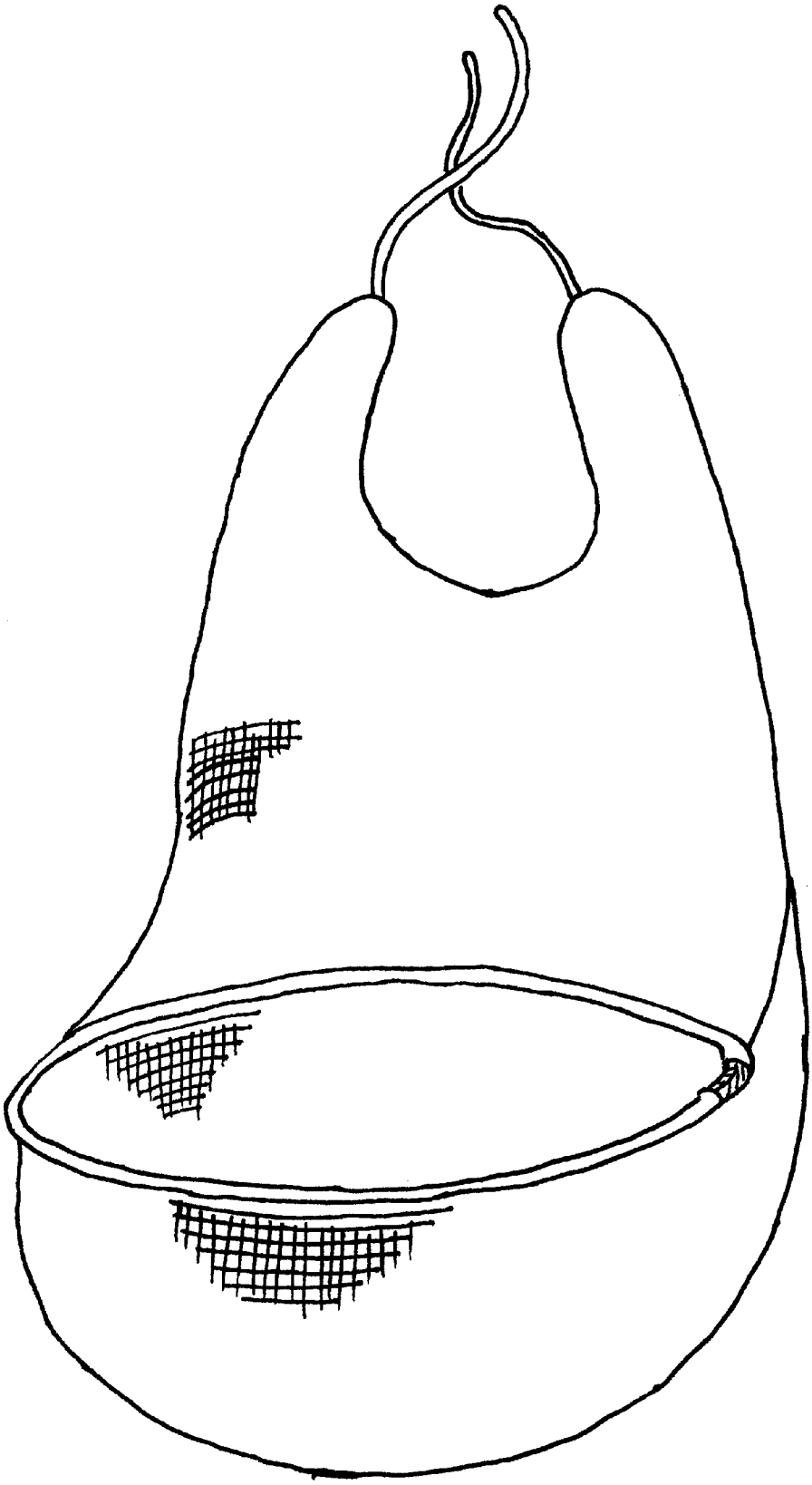
FIG. 1 is a plan view of an embodiment of the collapsible bib in it's open single-looped configuration.
Figure 2:
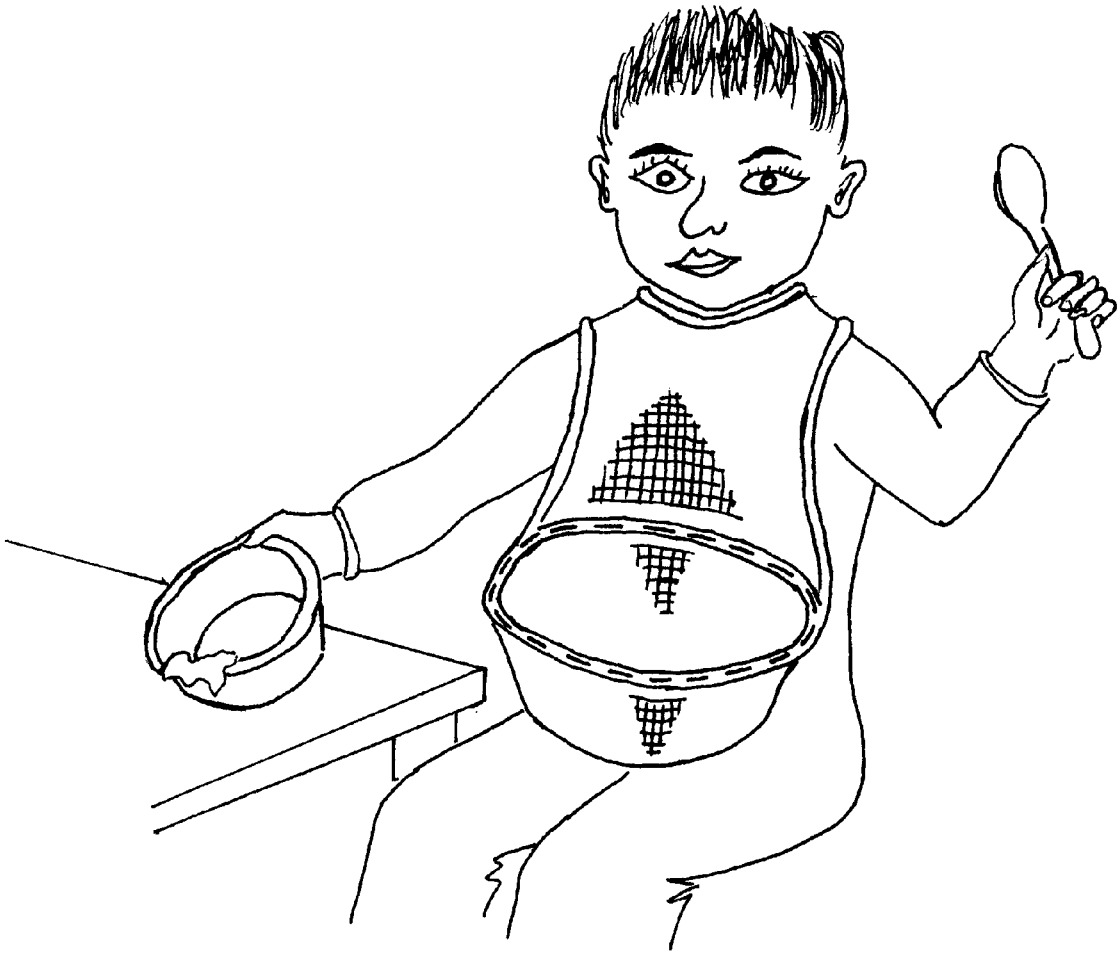
FIG. 2 is a prospective view of the collapsible bib in use, covering the lap and front of a wearer.

Referring to FIG. 1 through FIG. 3, a collapsible bib of the present invention includes a web of flexible material with a lower end having bowl configuration (FIG. 3 article 2), comprising a flexible spring material (FIG. 3 article 1), in the form of a single loop, which forms the upper edge periphery of said lower bowl section. Tension created by said spring material (FIG. 3 article 1), forces said lower bowl section (FIG. 3 article 2), out and open as to catch any spills which may occur. Said spring material is held in place either by having it inside a guide (FIG. 3 article 3), that is folded and sewn into the fabric of the web material, or by having it attached to the web by a fabric tape or bias tape that encircles said spring material.

When in the extended or open position (FIG. 1–4A), said spring loop exerts pressure on the upper edge of said lower bowl section's web material, holding it taut to form a relatively large round bowl. As shown in FIG. 3, article 5, and 6, the bib has a neck enclosure in which a wearer would fasten around their neck, in the form of ties.

Figure 4A:
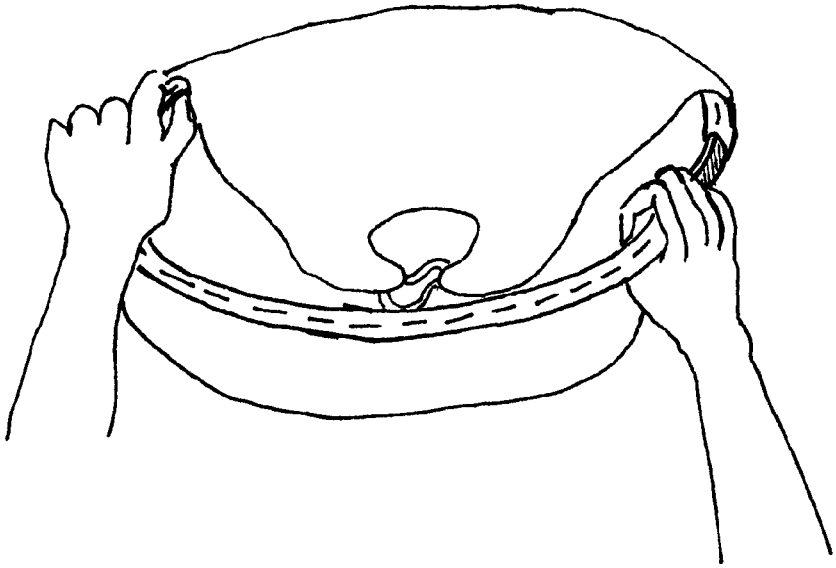
FIGS. 4(A) through 4(D) illustrate how the bib is collapsed when the upper half of the bib is laid down into said lower bowl section, (FIG. 4A), and the flexible spring element is twisted out of it's plane (FIG. 4B), to form a much smaller configuration of joined loop members (FIG. 4C). Preferred embodiments comprise a relatively small circular strap of elastic sewn onto the side of the bib used to wrap the folded multi-looped bib for storage.
Figure 4B:
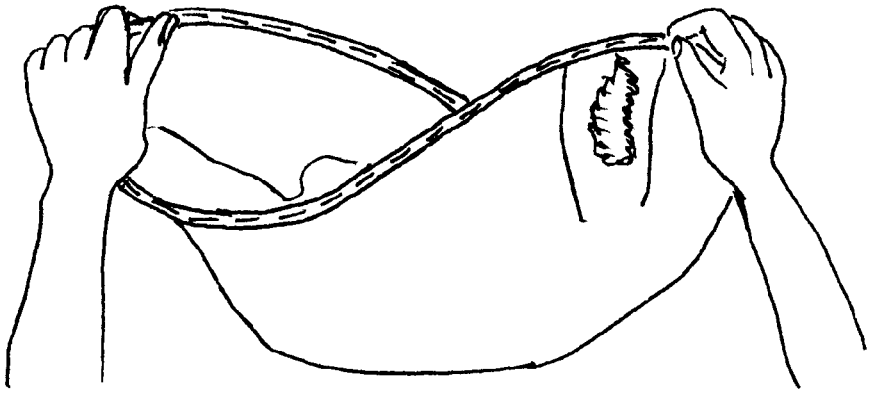
Figure 4C:
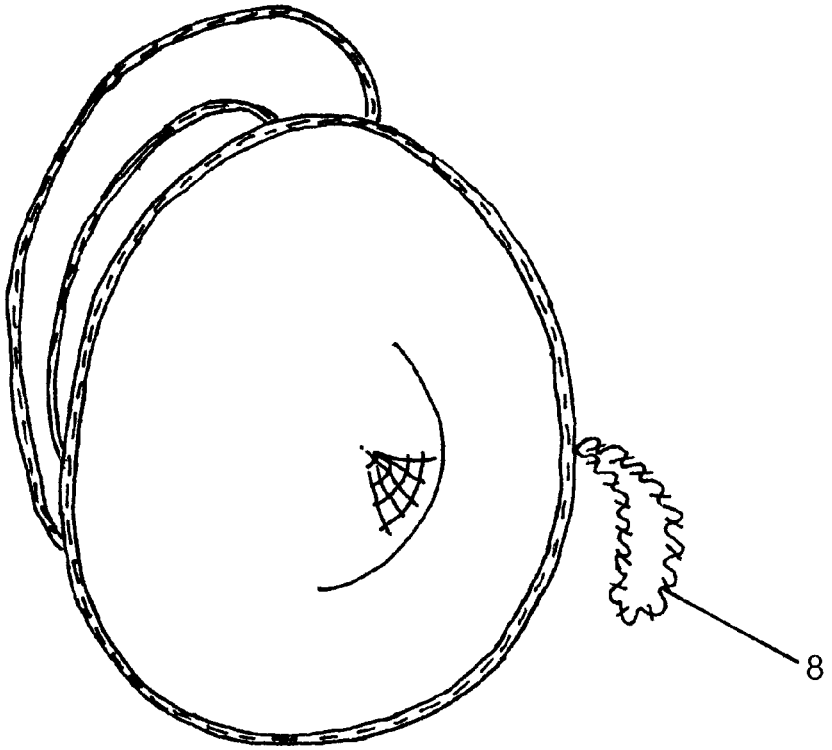
Figure 4D:
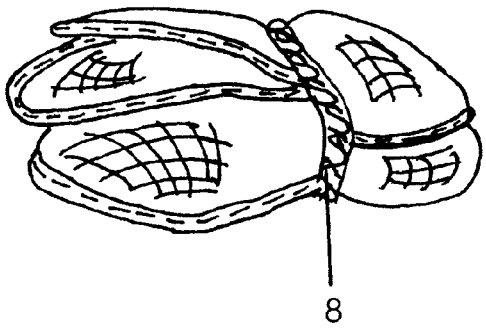

As shown in FIG. 4A, through FIG. 4D, the collapsible bib can be folded into a convenient small storage size simply by draping said top portion, including said neck enclosure down into said lower bowl section(as shown in FIG. 4A), and twisting said single-looped spring element out of it's plane (FIG. 4B), to form an odd number of smaller connected loops (FIG. 4C), once the bib has been folded into said smaller multi-looped configuration it can be wrapped with a small strap of elastic or the like material, which is sewn onto the side of said spring elements guide (FIG. 3 article 8). This will ensure that the folded bib will maintain it's storage configuration until it is needed for use again. When the bib is needed, simply remove the elastic strap (FIGS. 3 & 4D article 8), from around the folded multi-looped bib and twist said spring element in the opposite direction of that used to collapse the bib, the tension created by said spring element will force the bib to pop out into an open single-looped configuration comprising a large bowl at the lower portion of the bib. All that is needed is that the spring material be capable of reversibly forming the supporting loop at the periphery of said upper edge of said bowl.

The collapsible bib of the present invention is useful for covering a wearer's lap and protecting the immediate environment from spills. This can be especially useful when one is eating in the car or similarly confined space.

The relevant portions of all the patents cited herein are incorporated by reference.

Although the present invention has been described in the context of particular examples and preferred embodiments, it will be understood that the invention is not limited to such embodiments, instead, the present invention shall be measured by the claims that follow.

We claim:

1. A foldable bib, comprising:

a flexible web of sufficient size to protect the lap and immediate surrounding environment from spills, said web includes an upper and a lower portion and said web comprising a large bowl at the lower portion of the bib; and a flexible elongated spring material in the form of a loop attached to the periphery of the upper edge of the lower bowl portion and folded into smaller multi-looped configurations wherein the spring material is twisted out of the plane of the upper edge of the lower bowl section.

2. The bib of claim 1, wherein the spring applies outward tension along the entire upper edge of the lower bowl section to hold said lower bowl out in an open configuration.

3. The bib of claim 1, wherein a fabric tape encircles the spring and attaches the spring to the web.

4. The bib of claim 1, wherein the bib, once unfolded will pop-out automatically into shape, making said bib fun for infants and toddlers.

* * * * *